US006414704B1

(12) United States Patent
Yamashita

(10) Patent No.: US 6,414,704 B1
(45) Date of Patent: Jul. 2, 2002

(54) PRINTER INSTALLABLE IN SMALL SPACE

(75) Inventor: Akio Yamashita, Iwate-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/934,760

(22) Filed: Aug. 22, 2001

(30) Foreign Application Priority Data

Aug. 31, 2000 (JP) ..... 2000-268401

(51) Int. Cl.[7] ..... B41J 29/00
(52) U.S. Cl. ..... 347/222
(58) Field of Search ..... 347/222; 400/691, 400/692, 693

(56) References Cited

U.S. PATENT DOCUMENTS 4,641,980 A * 2/1987 Matsumoto et al. ..... 347/222
5,255,012 A * 10/1993 Amano ..... 347/222

FOREIGN PATENT DOCUMENTS

| | | |
|---|---|---|
| JP | 1-127851 | 8/1989 |
| JP | 11-78146 | 3/1999 |

* cited by examiner

*Primary Examiner*—Huan Tran
(74) *Attorney, Agent, or Firm*—Brinks Hofer Gilson & Lione

(57) ABSTRACT

There is provided a printer which does not require a space for opening and closing a body cover, can be installed in any place, and can be small and thin. A printing head is provided in a printer body having in its front an opening. A recording sheet is inserted into a housing of a cover provided with a platen roller. Part of the recording sheet is placed on the platen roller. The cover is inserted from the opening of the printer body into the printer body. The printing head is resiliently pressed through the recording sheet onto the platen roller.

3 Claims, 6 Drawing Sheets

PRINTER INSTALLABLE IN SMALL SPACE

BACKGROUND OF THE INVENTION

1. Field of the Invention

The present invention relates to a printer for forming predetermined image recording on a recording sheet using a printing head, more specifically, to a printer of a line thermal type installable in a small space.

2. Description of the Prior Art

Small printers constructed to form predetermined image recording on thermal paper, which is one of recording media, with use of a line thermal head have hitherto been in wide practical use.

As shown in FIG. 8, a printer of this type has a printer body 102 having an opening 102*a* in its upper portion, a body cover 103 connected to the upper rearward portion of the printer body 102 and pivoted in the direction of arrow A or B to be opened and closed so as to cover the opening 102*a*, a printing portion 104 for printing and recording letters or photo images on a roll sheet (thermal paper) 119, and a platen roller 105 provided in the front inner portion of the body cover 103 so as to be positioned opposite to a line-like thermal head 104*a* of the printing portion 104 when the body cover 103 is closed.

In the printer, one end side of the body cover 103 is pivotably supported on the printer body 102 through a hinge axis 110. The printer 102 is provided with a housing 120, so that a roll sheet 119 is housed rotatably in the housing 120.

The replacing operation of the roll sheet 119 in the printer will be described below. First, the operator opens the body cover 103. The body cover 103 is pivoted in the direction of arrow A. When the body cover 103 is opened to a predetermined position, the body cover 103 is retained in the opening position by a retaining portion, not shown. A new roll sheet 119 is inserted into the housing 120 of the printer body 102 to pivot the body cover 103 in the direction of arrow B. The roll sheet 119 is loaded in a predetermined position of the housing 120 of the printer body 102.

The front end of the roll sheet 119 is pulled and extended out of the printer 102. When the body cover 103 is closed, the front end side of the roll sheet 119 is held between the printing portion 104 and the platen roller 105.

The printer with the roll sheet 119 loaded drives the printing head 104*a*of the printing portion 104 corresponding to image recording information and rotates the platen roller 105 to print and record the image recording information in a predetermined position of the roll sheet 119.

Such a prior art printer requires a space for opening and closing the body cover 103 in the upper portion of the printer body 102, and must secure the space.

To secure the space, the position for installing the printer is limited so that the printer cannot be used in a small place such as a shelf. When the printer is installed in a high place, the operator has difficulties in replacing the roll sheet 119.

SUMMARY OF THE INVENTION

An object of the present invention is to provide a printer which requires no excess space for opening and closing a body cover, can be installed in any place, and can be small and thin.

As a first solving means for solving at least one of the foregoing problems, a printer comprises a printing head provided in a printer body having in its front an opening, wherein a recording medium is inserted into a housing of a cover provided with a platen member, wherein part of the recording medium is placed on the platen member, wherein the cover is inserted from the opening of the printer body into the printer body, wherein and the printing head is resiliently pressed through the recording medium onto the platen member.

As a second solving means, the printing head is provided through a biasing member in the printer body so as to be resiliently pressed onto the platen member provided in the cover by means of the biasing force of the biasing member.

As a third solving means, the printing head presses the cover forward through the platen member by means of the biasing force of the biasing member.

DESCRIPTION OF THE PREFERRED EMBODIMENTS

The printer of one embodiment of the present invention will be described hereinbelow with reference to FIGS. 1 to 7.

Figure 1:
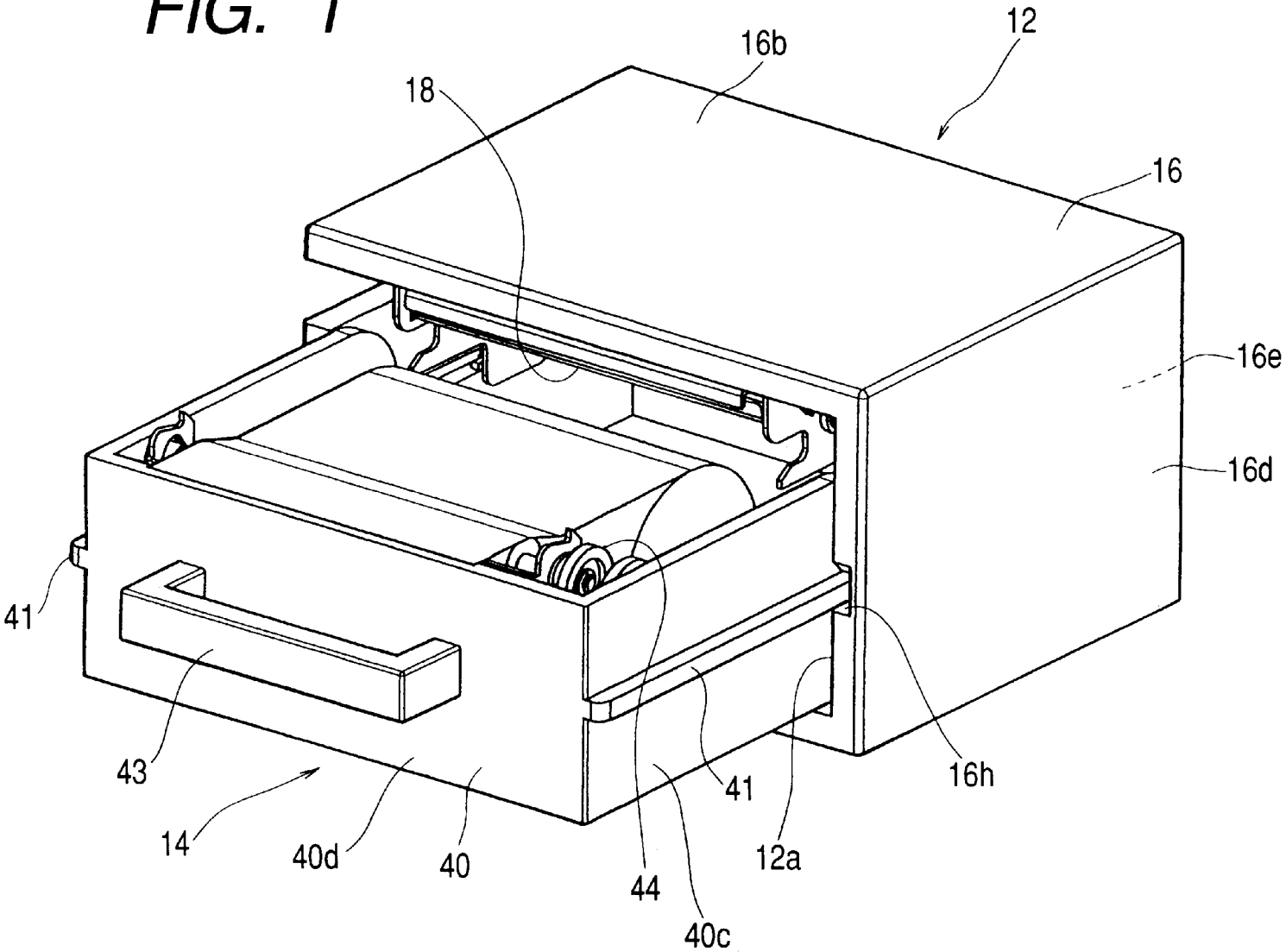
FIG. 1 is a general appearance diagram of a printer of one embodiment of the present invention.

The printer, as shown in its appearance shape of FIG. 1, has a rectangular parallelepiped printer body 12 having in its front an opening 12*a*, and a cover body 14 slid to the opening 12*a* of the printer body 12 to be inserted or removed.

The printer body 12 has a housing 16 of a metal or resin box shape having a hollow interior and a printer body mechanism 18 housed in the housing 16.

As shown in FIGS. 1 to 4, the housing 16 has a bottom plate 16*a*, a top plate 16*b*, side plates 16*c* and 16*d*, and a back surface 16*e*, and is surrounded by the bottom plate 16*a*, the top plate 16*b*, and the side plates 16*c* and 16*d*to form in its front the opening 12*a*. The housing 16 is almost of 1DIN (the German Industrial Standards) size applied to a vehicle-mounted acoustic device.

The inner walls of the side plates 16*c* and 16*d* are respectively formed with guide slots 16*g* and 16*h* in parallel with the bottom plate 16*a* and the top plate 16*b*and in the front and rear direction. The side plate 16*c*is formed in its forward side corner with a cutout 16*k*cut away in a rectangular shape.

As shown in FIGS . 2 and 3, the printer body mechanism 18 is made of a sheet metal and has a plate 18*a*, and side plates 18*b* and 18*c* formed by bending both edges of the plate 18*a* downward at a substantially right angle.

The plate 18*a* is formed with a rectangular hole 19 cut away in a rectangular shape. The front end of a flexible substrate 20 is drawn outside through the rectangular hole 19.

Figure 6A:
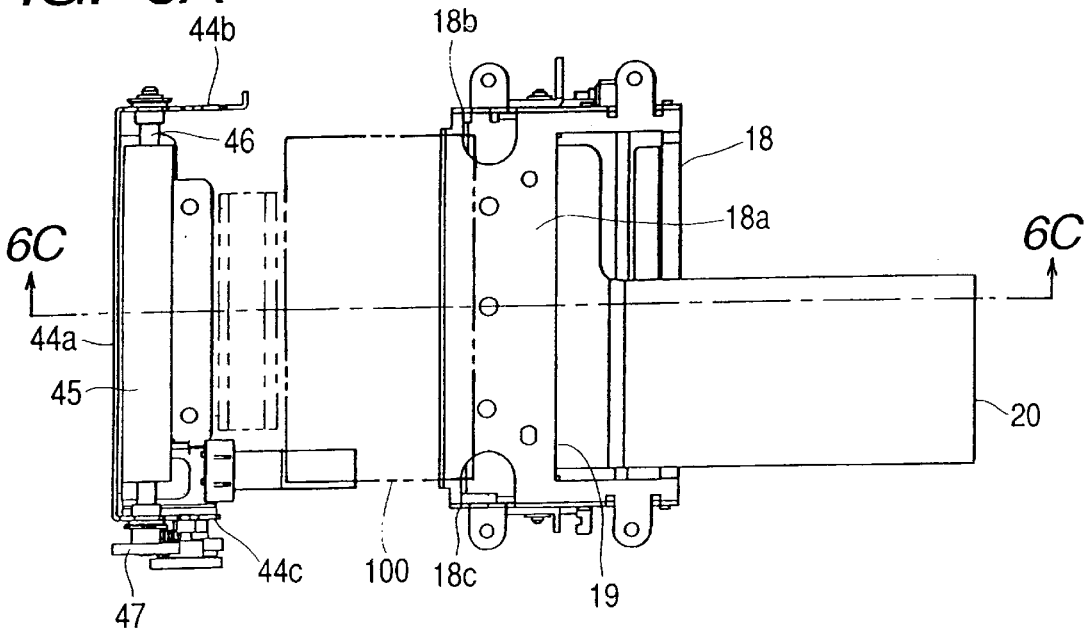
FIG. 6A is a plan view of the printer of one embodiment of the present invention when the cover is opened.
Figure 6B:
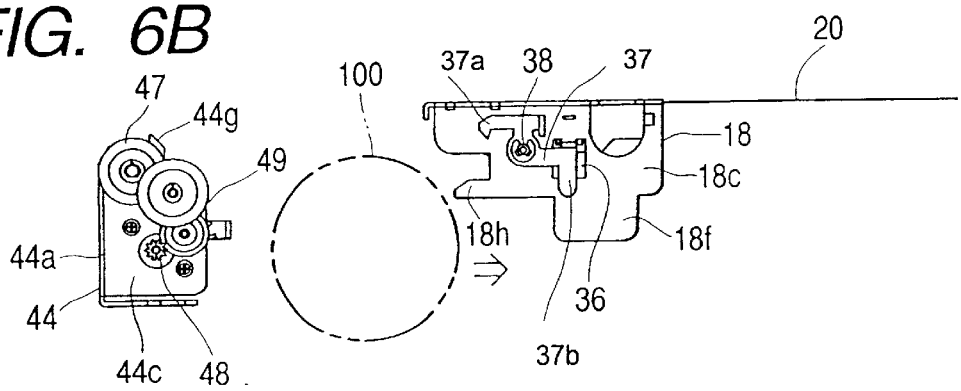
FIG. 6B is a side view of the printer.
Figure 6C:
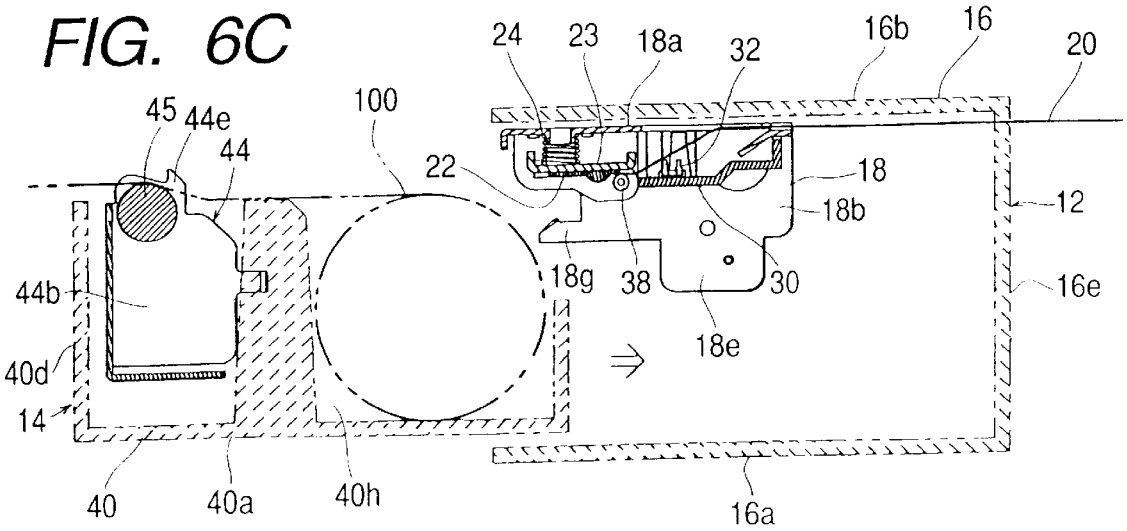
FIG. 6C is a cross-sectional view taken along line 6C—6C.
Figure 7A:
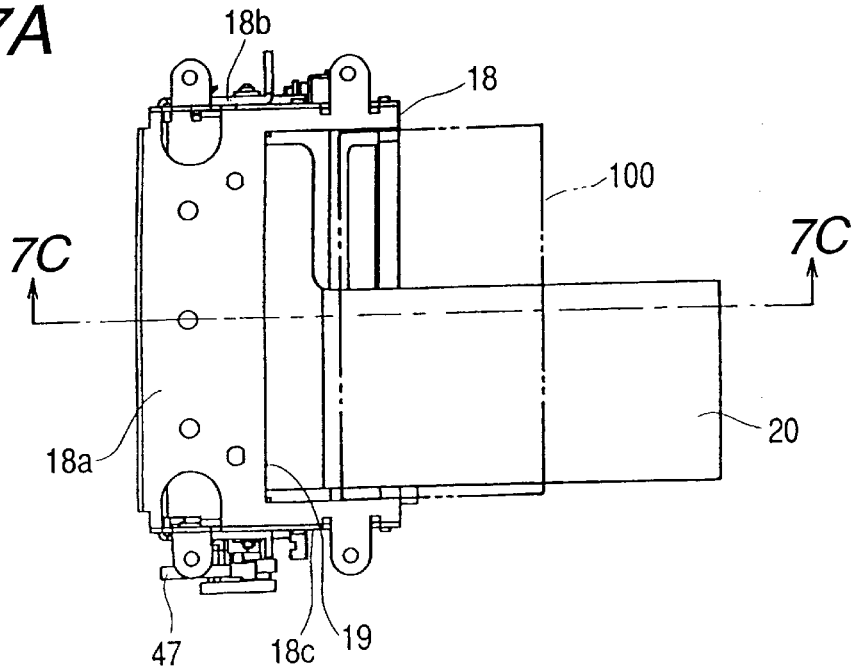
FIG. 7A is a plan view of the printer of one embodiment of the present invention when the cover is closed.
Figure 7B:
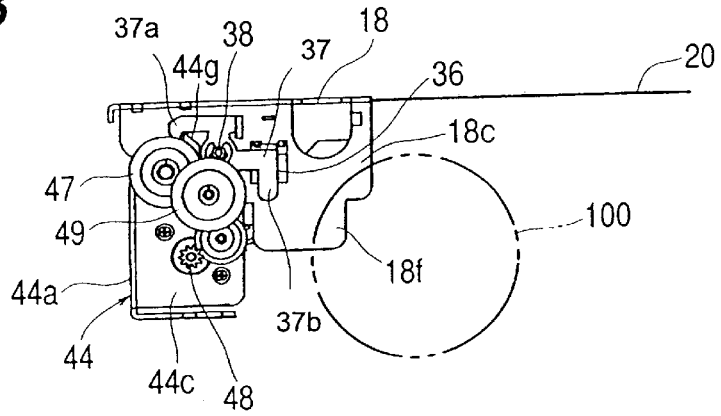
FIG. 7B is a side view of the printer.
Figure 7C:
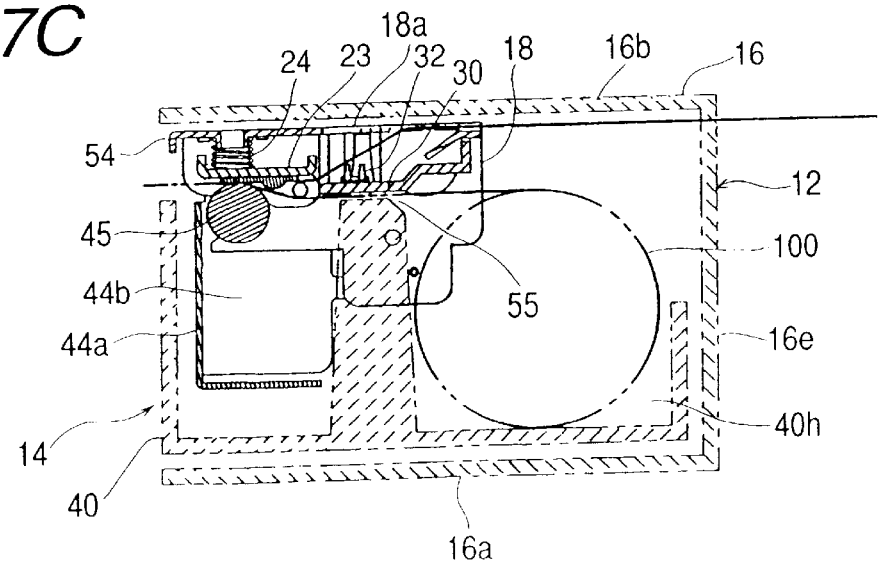
FIG. 7C is a cross-sectional view taken along line 7C—7C.
Figure 8:
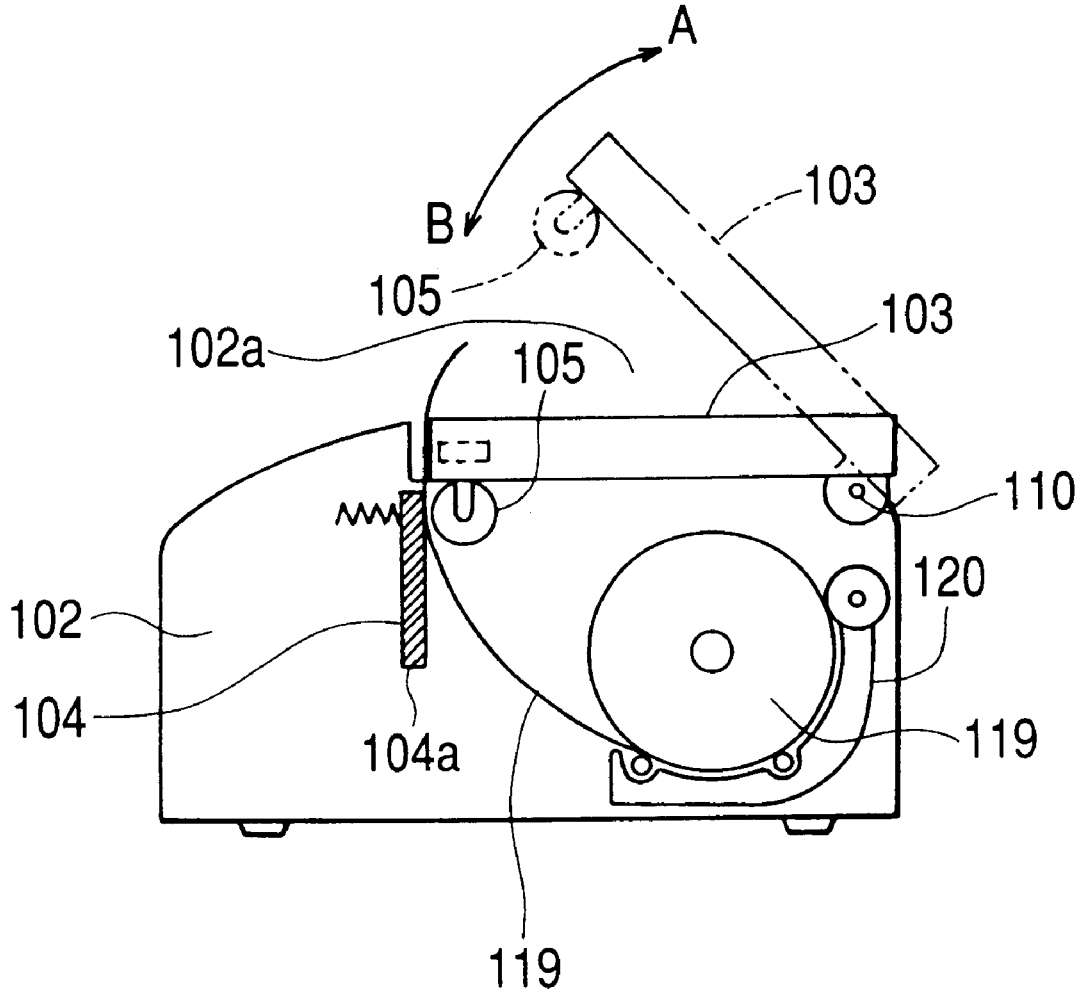
FIG. 8 PRIOR ART
FIG. 8 is a general side view of a prior art printer.

As shown in FIGS. 6C and 7C, the plate 18a is movably provided in its front side (the left side in the figure) through a plurality of coil springs (biasing members) 24, with a head holder 23 disposed between the side plates 18*b* and 18*c* and of a rectangular shape in the direction bridging them. The head holder 23 is provided in its surface with a line thermal printing head 22 having a plurality of heating elements and is electrically connected to the flexible substrate 20.

The planer 18*a* is provided in its rear side (the right side in the figure) with a sheet guide 30 for regulating sheet feeding. A photo sensor 32 is disposed in the sheet guide 30 to detect whether or not there is a recording sheet described later.

Figure 5:
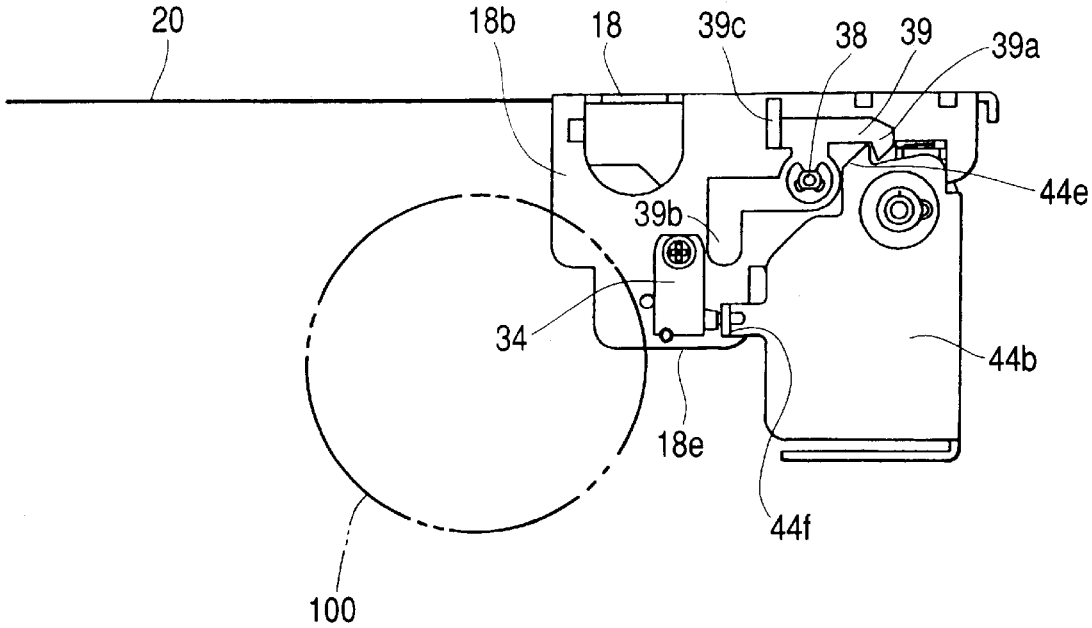
FIG. 5 is a general side view of the printer of one embodiment of the present invention.

As shown in FIGS. 6B and 6C, the side plates 18*b*and 18*c* are respectively provided in the lower end with protruding portions 18e and 18f protruding downward, and in the front side with guide projections 18*g* and 18*h*. As shown in FIG. 5, the protruding plate 18e of one side plate 18*b* is provided with a micro switch 34 to detect that the cover 14 is fitted or removed. The other side plate 18*c* is formed with a stopper strip 36 cut away and cut up.

Between the side plates 18*b* and 18*c*, an axial portion 38 of metal is supported rotatably.

Release levers 37 and 39 made of a sheet metal are substantially crank-shaped. One end thereof is provided with lock nail receiving portions 37*a* and 39*a*, respectively, and the other end thereof is provided with butting portions 37*b* and 39*b*, respectively. The respective middle portions of the release levers 37 and 39 are fitted in both ends of the axial portion 38, and are rotatably provided with the side plates 18*b* and 18*c* together with the axial portion 38. Near the lock nail receiving portion 39*a*of the release lever 39, a seizing portion 39*c* is bent at a substantially right angle.

A spring member, shown, normally retains the butting portion 37*b* of the release lever 37 to the stopper strip 36 in a biased state.

As shown in FIG. 1, the cover body 14 has a drawer-shaped cover member 40 made of metal or resin, and a platen holder 44 mounted in the cover member 40.

The cover member 40 has a bottom plate 40*a*, side plates 40*b* and 40*c* erected from both side edges of the bottom plate 40*a* and each having a long, convex-shaped guide projection 41 in the front and rear direction, and a front surface 40*d* connected integrally to the bottom plate 40*a* and the side plates 40*b* and 40*c*, and provided with a handle 43. The upper portion of the cover member 40 is an opening. The rear side in the cover member 40 is a housing 40*h* for housing a recording sheet described later (see FIG. 6C).

Figure 3:
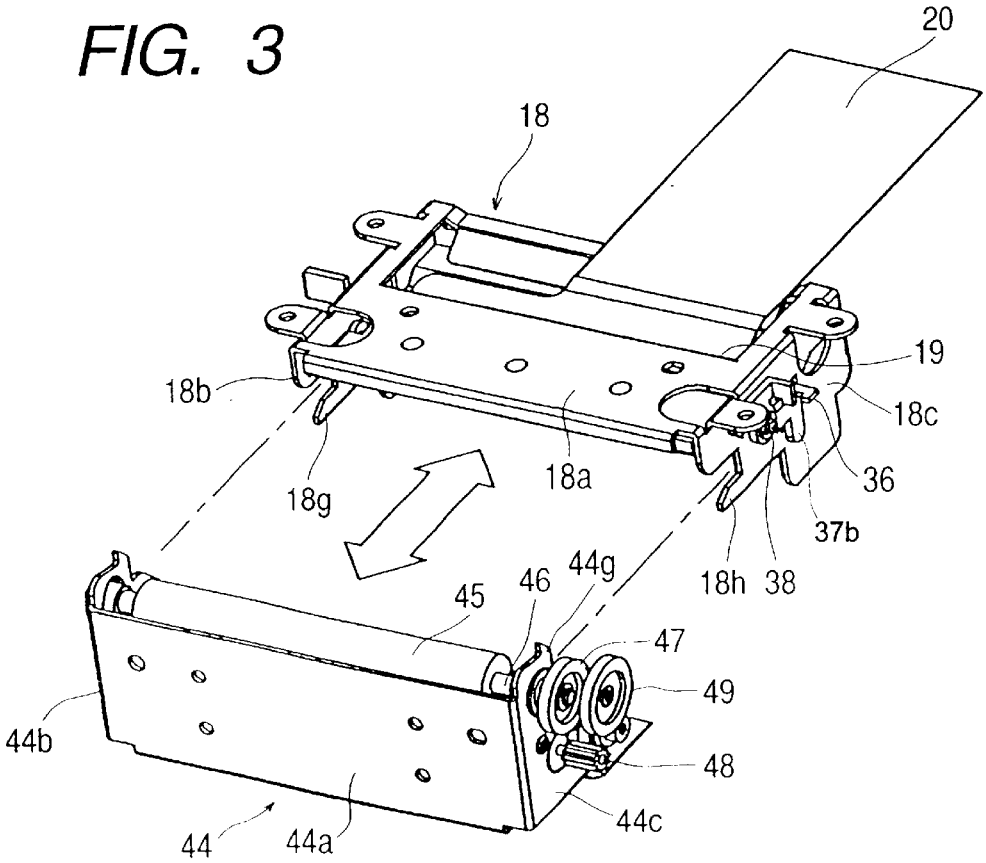
FIG. 3 is a perspective view of the printer of one embodiment of the present invention when the cover is opened.
Figure 4:
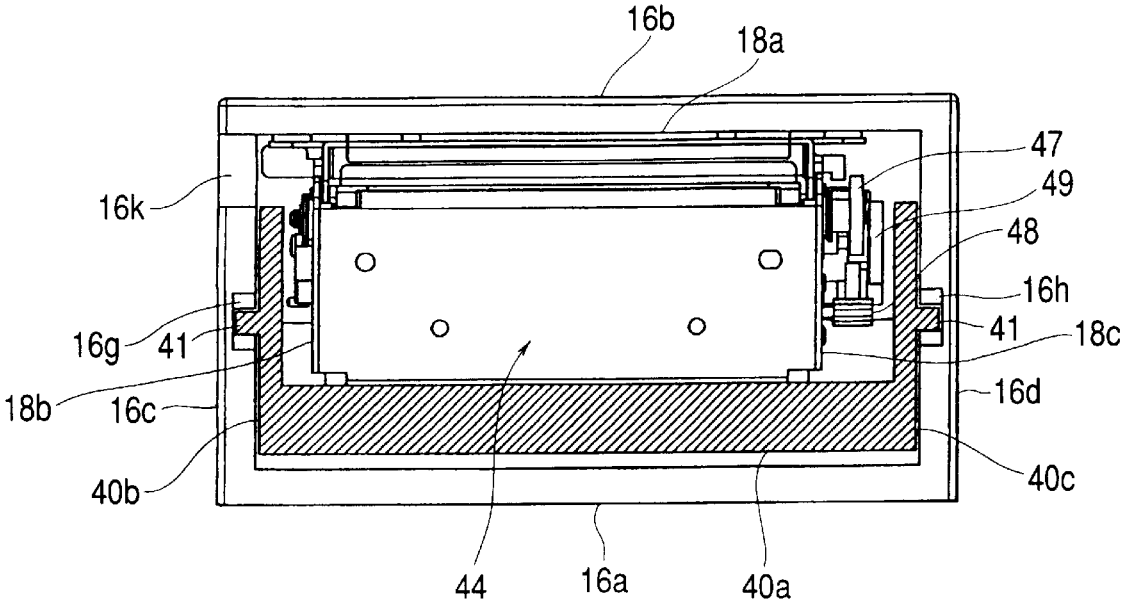
FIG. 4 is a longitudinal cross-sectional view of the printer of one embodiment of the present invention.

As shown in FIG. 3, the platen holder 44 has a rectangular-shaped front plate 44*a* made of a sheet metal, and a pair of side plates 44*b* and 44*c* bent rearward from both edges of the front plate 44*a*.

The forward side between the side plates 44b and 44*c* is provided with a cylindrical-shaped platen roller (platen member) 45 of an elastic member such as rubber or metal. The platen roller 45 is mounted on a metal shaft 46 rotatably supported on the side plates 44*b* and 44*c*. The shaft 46 is provided at one end with a gear 47.

As shown in FIG. 5, the upper side of the side plate 44*b* is formed with a lock nail 44*e*, and the rear side thereof is formed with a pressing portion 44*f* projecting rearward (the left side in FIG. 5) and having its front end bent at a substantially right angle.

Figure 2:
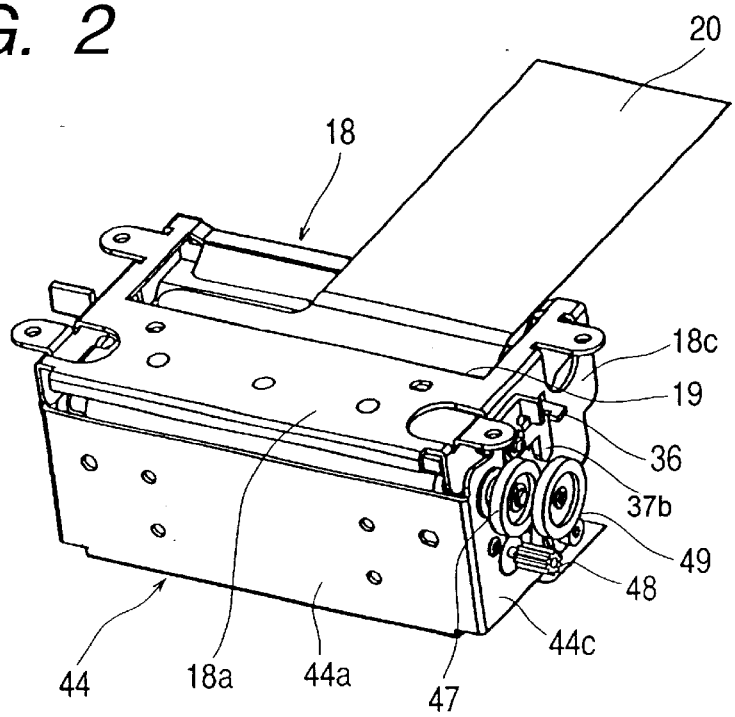
FIG. 2 is a perspective view of a printer mechanism of the printer of one embodiment of the present invention.

As shown in FIG. 2, a driving motor, not shown, is mounted on the inside of the side plate 44*c*, and a pinion 48 is mounted on the rotating axis of the driving motor. Gears 49 consisting of two gears are engaged with the pinion 48. The gears 49 are engaged with the gear 47 to rotatably drive the platen roller 45 by means of the driving force of the driving motor.

As shown in FIG. 3, the upper portion of the side plate 44*c* is formed with a lock nail 44*g* like the side plate 44*b*.

The operation for loading a roll-like recording sheet 100 to the printer will be explained with reference to FIGS. 6 and 7.

The recording sheet (recording medium) 100 has a width corresponding to the length of the printing head 22 mounted on the head holder 23 and is thermal paper thermally changed and colored by heating the line thermal head as the printing head 22, and wound in a roll form.

The recording sheet 100 is not limited to the thermal paper, and may be an ordinary or coated sheet according to the kind of the printing head 22 including a thermal method or an ink jetting method.

The operation of closing the cover 14 when removed and opened from the printer body 12, as shown in FIGS. 6A to 6C and FIG. 1, will be described. First, the recording sheet 100 is inserted into the opening of the cover member 40 to be housed in the housing 40*h* of the cover 14.

The front edge of the recording sheet 100 is pulled out forward to cover the periphery of the platen roller 45.

Then, the operator grabs the handle 43 so as to slide the cover 14 horizontally rearward while guiding the guide projection 41 of the cover member 40 along the guide slots 16*g* and 16*h* of the housing 16.

When the cover 14 is pressed and slid rearward in this manner, as shown in FIGS. 7A to 7C, the platen roller 45 is resiliently pressed onto the printing head 22 of the printer body mechanism 18 against the biasing force of the coil spring (biasing member) 24. The lock nails 44*e* and 44*g* of the platen holder 44 are respectively hit onto the lock nail receiving portions 37*a* and 39*a* of the release levers 37 and 39. As a result, the release levers 37 and 39 are slightly rotated together with the axial portion 38 against the biasing force of the spring member. The lock nail receiving portions 37*a* and 39*a* are respectively engaged with the lock nails 44*e* and 44*g* for locking.

At this time, as shown in FIG. 5, the pressing portion 44*f* of the platen holder 44 is pressed onto the micro switch 34 mounted on the side plate 18*b* which is then switched ON. The micro switch 34 detects that the cover 14 is mounted on the printer body 12 and closed.

The front end of the recording sheet 100 is resiliently pressed while being held between the printing head 22 and the platen roller 45. As shown in FIG. 7C, the front of the pressed portion is formed with an ejection portion 54 for ejecting the recording sheet 100, and the rear of the pressed portion is formed with a sheet carrying path 55 between the partition of the housing 40*h* and the sheet guide 30. The photo sensor 32 detects that the recording sheet 100 is in the sheet carrying path 55.

In this manner, the printer body 12 fits the cover 14 so as to load the recording sheet 100.

The operation of opening the cover 14 such as removing the core winding the recording sheet 100 from the printer.

First, the seizing portion 39*c* of the release lever 39 is pressed in the cutout 16*k* of the housing 16 rearward (the left side of FIG. 2), the release levers 37 and 39 are pivoted counterclockwise against the spring member, not shown, together with the axial portion 38 to move the lock nail receiving portions 37*a* and 39*a* away from the lock nails 44*e* and 44*g*. When the locking is released, the pressing to the micro switch 34 is released to switch it OFF to detect that the locking is released.

At this time, the printing head 22 presses forward the entire cover 14 through the platen roller 45 by means of the biasing force of the coil spring 24. The cover 14 is slightly protruded from the opening 12*a* of the printer body 12.

When the handle 43 is pulled, no friction is caused in the initial operation. The cover member 40 can thus be slid smoothly forward.

The printing operation of the printer in which the cover 14 is fitted into the printer body 12 and closed will be described below. Based on image recording signals applied to a plurality of printing heads 22 through the flexible substrate 20, predetermined image recording is formed onto the recording sheet 100 by heating the printing head 22.

At this time, the driving force of the driving motor, not shown, rotates the pinion 48 mounted on the rotating shaft of the driving motor and is then transmitted through the gears 49 and the gear 47 to rotate the platen roller 45. The platen roller 45 is rotated to feed the recording sheet 100 housed in the housing 40*h* in the sheet carrying path 55 onto which is the sheet 100 is image recorded. The recording sheet 100 is carried from the ejection portion 54 outside (forward).

The printer of this embodiment thus constructed and operated has the following effects.

1) The printing head 22 is provided in the printer body 12 having in its front the opening 12*a*. The recording sheet 100 is inserted into the housing 40*h* of the cover 14 provided with the platen roller 45. Part of it is placed on the platen roller 45. The cover 14 is inserted from the opening 12*a* of the printer body 12 into the printer body 12. The printing head 22 is resiliently pressed through the recording sheet 100 onto the platen roller 45. The cover 14 can thus be slid in the front and rear direction so as to be opened and closed. An excess space for opening and closing the cover 14 in the upper portion of the printer body 12 is unnecessary. The printer can be installed in a small place.

In particular, a vehicle-mounted printer can be installed in an accessory box in the front panel like a car stereo. The use range of the printer can be extended.

2) The printing head 22 is provided through the coil spring 24 on the printer body 12. The printing head 22 is resiliently pressed onto the platen roller 45 mounted on the cover 14 by means of the biasing force of the coil spring 24. The operator strongly fits the cover 14 into the printer body 12. When the platen roller 45 is brought into contact with the printing head 22, the coil spring 24 can attenuate the pressing force to prevent the printing head 22 from being broken.

3) The printing head 22 presses the cover 14 forward through the platen roller 45 by means of the biasing force of the coil spring 24. The cover 14 is protruded slightly from the platen body 12. In its initial operation, the sliding friction can be reduced to pull out the cover 14 smoothly.

One of the printer body 12 and the cover 14 is provided rotatably through the spring member with the release levers 37 and 39 having lock nails 44*e* and 44*g*. The other is provided with the lock nail receiving portions 37*a* and 39*a*. When the cover 14 is inserted into the printer body 12 to be closed, the release levers 37 and 39 are pivoted against the resilient biasing force of the spring member to retain the lock nails 44*e* and 44*g* to the lock nail receiving portions 37*a* and 39*a*. The cover 14 can be reliably held to the printer body 12 even when the printer is installed obliquely.

5) When the printer is installed in a small place such as a shelf or a high place, the cover 14 may be pulled out forward to replace the recording sheet 100. The replacing operation can be done easily.

One embodiment of the present invention is described above. The present invention is not limited to the embodiment, and can be modified and embodied in the scope without departing the main purpose.

For example, the printer is described by taking the printer of a line thermal head type as an example. Needless to say, the printer can be applied not only to the thermal printer, but also to various types of printers, facsimiles, and other electronic equipment which slide the cover in the front and rear direction to open it and house a roll sheet in the housing.

The printer of the present invention described above is provided with a printing head in a printer body having in its front an opening, wherein a recording medium is inserted into a housing of a cover provided with a platen member, wherein part of the recording medium is placed on the platen member, wherein the cover is inserted from the opening of the printer body into the printer body, and wherein the printing head is resiliently pressed through the recording medium onto the platen member. The cover can be slid in the front and rear direction to be opened and closed. An opening and closing space is unnecessary in the upper portion of the printer body. The printer can be installed in any place to extend the installing range.

What is claimed is:

1. A printer comprising a printing head provided in a printer body having a front with an opening, wherein a recording medium is inserted into a housing of a cover provided with a platen member, wherein part of the recording medium is placed on the platen member, wherein the cover is inserted from the opening of the printer body into the printer body, and wherein the printing head is resiliently pressed through the recording medium onto the platen member.

2. The printer according to claim 1, wherein the printing head is provided through a biasing member in the printer body so as to be resiliently pressed onto the platen member provided in the cover by means of the biasing force of the biasing member.

3. The printer according to claim 2, wherein the printing head presses the cover forward through the platen member by means of the biasing force of the biasing member.

* * * * *